United States Patent [19]

Fleissner

[11] Patent Number: 4,599,939

[45] Date of Patent: Jul. 15, 1986

[54] PROCESS FOR WRAPPING SQUARE BALES

[75] Inventor: Gerold Fleissner, Chur, Switzerland

[73] Assignee: Vepa Aktiengesellschaft, Riehen, Switzerland

[21] Appl. No.: 687,755

[22] Filed: Dec. 31, 1984

[30] Foreign Application Priority Data

Dec. 29, 1982 [DE] Fed. Rep. of Germany ..... 3347397

[51] Int. Cl.[4] ..... B65B 13/02

[52] U.S. Cl. ..... 100/2; 206/83.5

[58] Field of Search ..... 100/1, 2, 8, 13, 27; 53/589; 206/597, 83.5

[56] References Cited

U.S. PATENT DOCUMENTS 275,366 4/1883 Dederick ..... 206/83.5
3,080,811 3/1963 Freudling ..... 100/2

FOREIGN PATENT DOCUMENTS 661000 9/1938 Fed. Rep. of Germany ..... 100/1
465106 4/1914 France ..... 100/8
1065069 5/1954 France ..... 206/83.5

*Primary Examiner*—Billy J. Wilhite
*Attorney, Agent, or Firm*—Antonelli, Terry & Wands

[57] ABSTRACT

The invention relates to a process and apparatus for wrapping square bales, especially fiber bales, with the aid of strip-shaped baling material, preferably baling wire. It is known to compress fibers, after having been manufactured as raw material, into fiber bales and to hold the latter together with the aid of baling wire. In this process, several baling wires are placed in individual turns around the bale and joined at their ends. This type of wrapping is complicated and is to be simplified.

The basic aspect of the invention resides in that the baling wire is placed continuously around the bale and that the wire turns extend, on at least two mutually opposed bale sides, in parallel to one another as well as in parallel to bale edges.

7 Claims, 9 Drawing Figures

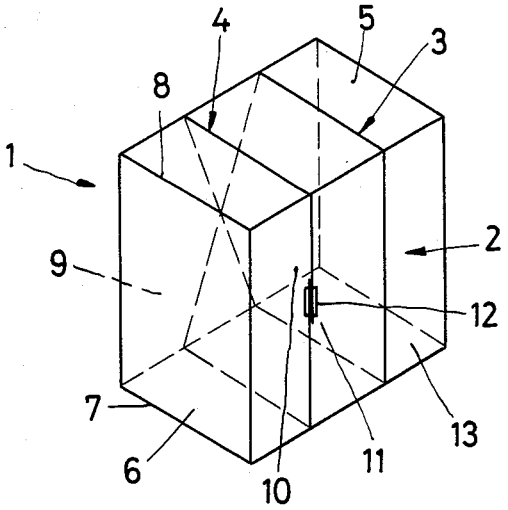
Fig.1
Fig. 2
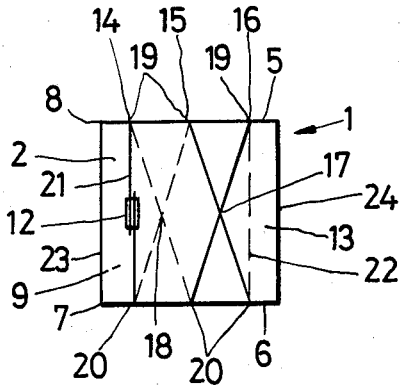
Fig.4
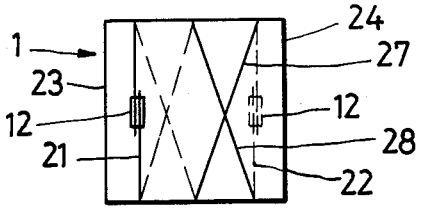
Fig.3
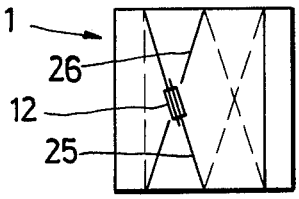
Fig.5
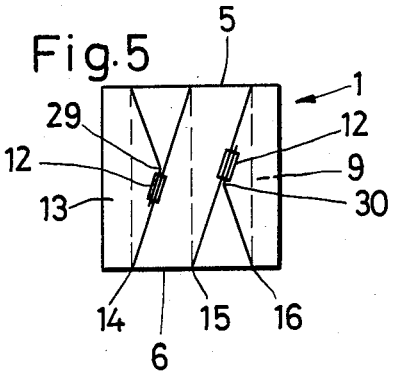

PROCESS FOR WRAPPING SQUARE BALES

The invention relates to a process and apparatus for the wrapping of square bales, especially fiber bales, with the aid of strip-shaped baling material, preferably baling wire. It is known to compress fibers, after having been manufactured as raw material, into fiber bales and to hold the latter together with the aid of baling wire. In this process, several baling wires are placed in individual turns around the bale and connected together at their ends. This type of wrapping is complicated and is to be simplified.

In order to solve this problem, the invention provides that the baling wire is placed continuously around the bale and that the wire turns extend on at least two mutually opposed bale sides in parallel to one another as well as in parallel to the bale edges.

The selected arrangement of the baling wire and/or of the wire turns imparts to the bale a maximum degree of strength and can be obtained in an automatic baling installation within short operating periods. Furthermore, in this process there do not occur any large-area zones on the bale surface which would be unsecured. Additionally, the bale, consisting of individual fibers, is, with the selected arrangement of the wire loops, extraordinarily stable dimensionally and is also capable of withstanding external loads, such as, for example, during transporting or storage. With the arrangement of this invention, fiber bales can thus be wrapped inexpensively and economically, and they retain the intended bale shape even after discharge from the baling installation, this being important, above all, for the subsequent further processing of the fibers.

Additional features of the invention can be seen from the specification and claims in conjunction with the drawings.

The invention will be described in greater detail below with reference to embodiments illustrated in the drawings wherein:

FIG. 1 shows a perspective view of a bale wrapped in accordance with the invention;

FIGS. 2 and 3 show lateral views of a bale with a baling wire and an odd number of wire turns;

FIGS. 4 and 5 show lateral views of a bale with two baling wires and an odd number of wire turns;

Figure 6:
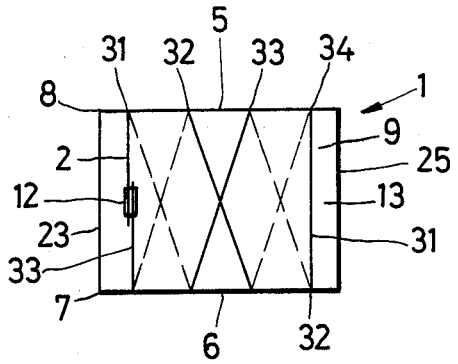
FIGS. 6 and 7 show lateral views of a bale with a baling wire and an even number of wire turns.

According to FIG. 1, a bale 1 is wrapped continuously with a baling wire 2, the wire turns 3 and 4 extending on two mutually opposed bale sides 5 and 6 in parallel to each other, as well as in parallel to the bale edges 7, 8. The bale sides 5, 6 preferably constitute the topside and underside, respectively, of the bale 1. With the use of a single baling wire 2 and with the arrangement of two looping wire turns 3, 4, these turns intersect preferably only on one side 9 of the bale 1, and the two wire ends 10, 11 are lead-sealed together or are affixed to each other by a lead seal 12. Suitably, the lead seal 12 is located on the front side 13 in accordance with the illustration in FIG. 1.

The two FIGS. 2 and 3 show the use of a baling wire 2 and the arrangement of three wire turns 14, 15 and 16 lying on opposite bale sides 5, 6 in parallel to one another and to the bale edges 7, 8. On the rear side 9 as well as on the front side 13, the baling wire 2 extends partially in an oblique or parallel direction with respect to the bale edges 7, 8, there being a point of intersection 17 on the front side 13 and a point of intersection 18 on the rear side 9 of the bale 1.

As in the embodiment of FIG. 1, the loops 14, 15 and 16 extend respectively in the zone of the topside 5 and of the underside 6 of the bale 1 in parallel to the bale edges 7 and 8, while they run on the front side 13 and on the rear side 9 respectively obliquely for joining the parallel-positioned turn sections on the topside 5 of the bale 1 with the likewise parallel-positioned turn sections 20 on the underside 6.

With the use of three wire turns 14, 15 and 16 according to FIGS. 2–5, or of an arbitrary number of non-linear wire turns, respectively one turn section 21 and 22 is located in a parallel position with respect to the bale edges 23, 24 also on the front side 13 and on the rear side 9, respectively, as can be seen from FIGS. 2–5.

The embodiment according to FIG. 2 differs from the embodiment of FIG. 3 only by the arrangement and position of the lead seal 12. In case of the bale 1 as shown in FIG. 2, the lead seal 12 joins the wire ends in the zone of the externally located winding section 21 disposed on the front side 13 of the bale. In the arrangement according to FIG. 3, the lead seal 12 is in the zone of an obliquely extending winding section 25 and/or in the zone of a point of intersection produced by the winding sections 25, 26.

The embodiment according to FIG. 4 differs from the embodiment of FIG. 2 only by the use of two series-arranged wires 27, 28 which are joined by lead seals 12 and constitute the baling wire 2. Here again, the lead seals 12 are located in the region of the turn sections 21, 22 extending in parallel to the bale edges 23, 24.

In the embodiment according to FIG. 5, the wire turns lie in parallel to the bale edges on three bale sides, i.e. the topside 5, the underside 6, and the rear side 9, and they extend in a Y-shape on the front side. In the zone of the junction points 29, 30, the lead seals 12 are arranged.

FIGS. 6–9 show various embodiments with respectively four wire turns 31, 32, 33 and 34 and with winding sections extending correspondingly on the bale topsides 5 and the bale undersides 6 in parallel to bale edges. In this connection, the baling wire 2 is extended from the lead seal 12 on the front side 13 first to the topside 5, then runs over the latter in parallel to the bale edge 8 and thereafter extends, on the rear side 9, obliquely to the bale edge 23. In the region of the bale underside 6, the baling wire 2 then again extends in parallel to the bale edge 7 and subsequently runs, in turn, obliquely over the bale front side 13 until it reaches the bale topside 5 and there again lies in parallel to the bale edge 8. This type of wrapping and/or baling is continued down to the last winding section 31 lying in an edge-parallel fashion on the front side 13 of the bale 1. From the winding section 32 on the bottom side, the baling wire 2 then runs in the same way back to the lead seal 12, which latter is likewise located on the front side 13 in the zone of a first, edge-parallel turn section 33.

Figure 7:
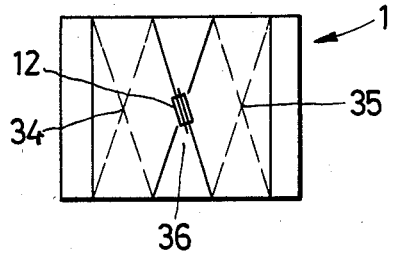

The embodiment of FIG. 7 differs from the embodiment of FIG. 6 only by the location of the lead seal 12. Both embodiments comprise, on the rear side 9, two points of intersection 34, 35, and on the front side 13, one point of intersection 36. In the arrangement of FIG. 7, the lead seal 12 lies in the region of the forwardly located point of intersection 36.

Figure 8:
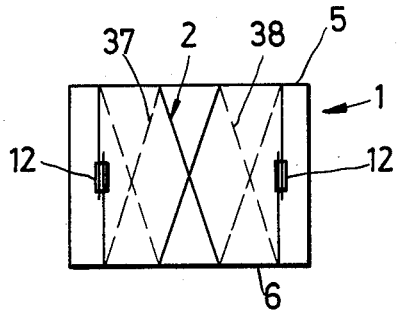
FIGS. 8 and 9 show lateral views of a bale with two baling wires and an even number of wire turns.

The embodiment according to FIG. 8 corresponds to the embodiment of FIG. 6 except that the baling wire consists of two series-arranged wires 37, 38 joined by lead seals 12. Therefore, here again the winding sections are edge-parallel on the topside 5 and on the bottom side 6 whereas they extend obliquely on the front side 13 and on the rear side 9.

If the baling wire 2 has more than four, but basically even-numbered, wire turns and/or edge-parallel winding sections 31–34, then these extend on the bale 1 basically in the same way as illustrated in FIGS. 6–8.

Figure 9:
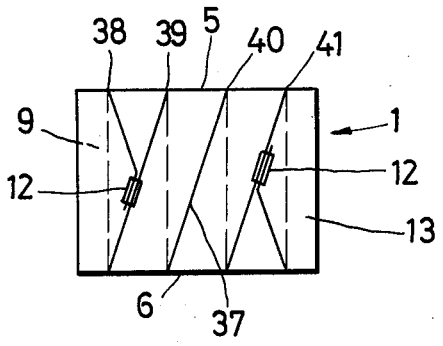

The arrangement of the wire turns in the embodiment of FIG. 9 is chosen to be the same as in the embodiment of FIG. 5, with the difference that the number of turns in one case is odd and in the other case even. The wire ends are again secured by means of lead seals 12 in such a way that the turn sections on the front side 13 of the bale 1 extend in a Y-shape, whereas they run otherwise over the bale topside 5 as well as over the bale underside 6 and the bale rear side 9 in an edge-parallel fashion. Additionally, a turn section 37, with a total of four wire loops 38, 39, 40 and 41, respectively, likewise extends obliquely on the front side 13 of the bale 1. With more than four wire loops, a correspondingly greater number of obliquely extending winding sections 37 will result.

The baling wire 2 is normally a single wire. It can be a flat wire. Furthermore, it is especially advantageous to use, as the baling wire, a wire pair, i.e. two individual wires in direct juxtaposition.

I claim:

1. A process for the wrapping of square bales with the aid of a flexible wrapping material characterized in that the wrapping material is continuously wound at least two times around the bale on four sides, that the turns of the winding material extend, on at least two mutually opposite bale sides, only in parallel to each other, as well as in parallel to the bale edges, and that on one of the four bale sides, two of the turns of the wrapping material intersect obliquely with each other.

2. A process according to claim 1, characterized in that the turns of the winding material lie on a topside and an underside of the bale in parallel to the bale edges.

3. A process according to claim 1, characterized in that the wrapping material is baling wire and by an arrangement of an odd number of wire turns lying in parallel to one another and to the bale edges on opposite bale sides.

4. A process according to claim 1, characterized in that the wrapping material is baling wire and by an arrangement of an even-number of wire turns which lie on opposite bale sides in parallel to one another and to the bale edges.

5. A process according to claim 1, characterized in that the wrapping material is baling wire and by an arrangement of two series-connected wires forming a baling wire, said wires being joined together by a lead seal.

6. A process according to claim 1, characterized in that the wrapping material consists of two individual wires together forming a baling wire.

7. A process for the wrapping of square bales, especially fiber bales with the aid of flexible baling wire, characterized in that the baling wire is laid continuously around the bale, that the wire turns extend on at least two mutually opposed bale sides, in parallel to each other as well as in parallel to the bale edges and that two looped-around wire turns are provided, said turns intersect only on one side of the bale and the wire ends are lead-sealed together.

* * * * *